US006319064B1

(12) United States Patent
Belopolsky et al.

(10) Patent No.: US 6,319,064 B1
(45) Date of Patent: Nov. 20, 2001

(54) MODULAR JACK WITH FILTER INSERT AND CONTACT THEREFOR

(75) Inventors: Yakov Belopolsky, Harrisburg; Robert E. Marshall, Elizabethtown, both of PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/338,354

(22) Filed: Jun. 22, 1999

(51) Int. Cl.[7] ..... H01R 13/66
(52) U.S. Cl. ..... 439/620; 439/941
(58) Field of Search ..... 439/620, 636, 439/637, 79, 676, 941

(56) References Cited

U.S. PATENT DOCUMENTS

| | | | | |
|---|---|---|---|---|
| 4,808,113 | | 2/1989 | Kanesige et al. | 439/67 |
| 5,015,204 | | 5/1991 | Sakamoto et al. | 439/620 |
| 5,078,611 | | 1/1992 | Tanigawa et al. | 439/78 |
| 5,194,017 | | 3/1993 | Consoli | 439/492 |
| 5,199,884 | | 4/1993 | Kaufman et al. | 439/74 |
| 5,219,305 | | 6/1993 | Kawaguchi et al. | 439/620 |
| 5,257,948 | | 11/1993 | Peterson | 439/571 |
| 5,387,112 | | 2/1995 | Chishima | 439/67 |
| 5,403,207 | | 4/1995 | Briones | 439/620 |
| 5,456,619 | * | 10/1995 | Belopolsky et al. | 439/620 |
| 5,474,468 | | 12/1995 | Chishima et al. | 439/495 |
| 5,528,408 | | 6/1996 | McGinley et al. | 359/152 |
| 5,647,767 | | 7/1997 | Scheer et al. | 439/620 |
| 5,687,233 | | 11/1997 | Loudermilk et al. | 379/442 |
| 5,688,143 | | 11/1997 | McHugh et al. | 439/495 |
| 5,704,808 | | 1/1998 | Chishima | 439/571 |
| 5,726,611 | | 3/1998 | Takagi et al. | 333/181 |
| 5,736,910 | | 4/1998 | Townsend et al. | 333/181 |
| 5,766,043 | * | 6/1998 | Talend | 439/676 |
| 5,971,805 | * | 10/1999 | Belopolsky et al. | 439/620 |
| 5,999,400 | * | 12/1999 | Belopolsky et al. | 439/620 |

* cited by examiner

*Primary Examiner*—Renee Leubke
*Assistant Examiner*—Briggitte R. Hammond
(74) *Attorney, Agent, or Firm*—Woodcock Washburn Kurtz Mackiewicz & Norris LLP

(57) ABSTRACT

A modular jack has an insulative insert having outer walls defining a first recess therein. The insert is mounted within an insulating housing interior section. A cap having outer walls defining a second recess therein is mounted within the insert first recess so that the first and second recesses together form an internal cavity for receiving an electrical device. First and second elongate portions of a conductive contact together securely grasp the insert outer wall and a bridging portion of the contact resides at the insert outer wall edge. The cap also has a rear wall having a rear face that faces in a rear direction, and the contact also has a rear portion adjacent the cap and facing in the rear direction. The cap rear wall rear face extends farther in the rear direction than the contact rear portion. A grounding shield fits over the jack and has a planar rear panel with a rear face that faces in the rear direction. The rear panel covers the cap rear wall rear face and the contact rear portion.

20 Claims, 12 Drawing Sheets

MODULAR JACK WITH FILTER INSERT AND CONTACT THEREFOR

FIELD OF THE INVENTION

The present invention relates to electrical connectors and more particularly, to electrical connectors in which noise filter means are incorporated.

BACKGROUND OF THE INVENTION

In electronic appliances containing modular jacks, various types of filters are used to reduce or eliminate noise. Such filters may include a three terminal capacitor or a common mode choke coil. A disadvantage in the use of such filters is that they may complicate the production of the circuit board. A need, therefore, has been perceived for providing a simple means of filtering noise in modular jacks.

The use of an integral ferrite element for this purpose is proposed in Japanese Patent Publication 64-2273. This reference discloses a modular jack having a modular insert installed in a casing. The body of the insert is formed with ferrite, and on one side of the insert body insert holes are formed for introducing connecting lines to be connected to respective contact springs.

While this reference would appear to simplify the apparatus used for noise filtering in modular jacks, a need for further increasing the compactness of such modular jacks with integral ferrite elements exists. U.S. Pat. No. 5,456,619 discloses a filtered modular jack assembly having an outer insulative housing with open front and rear sides. A ferrite element with vertical conductive wires is positioned adjacent the rear end, and an elongated insulative insert is superimposed over the ferrite element. The insulative insert is fixed to the housing, and the conductive wire extends vertically from the ferrite element over the upper side of the insert to its terminal end and then bends downwardly and rearwardly to rest on the top surface of an interior medial wall in the housing. While this reference discloses an invention which increases compactness, a need still exists for a jack which can achieve such compactness while using alternate types of filtering elements which arc not adapted to be mounted in the same way as the ferrite element.

A need also exists for such a compact jack that can accept multiple types of contacts for contacting respective contact-receiving elements on an underlying substrate. In addition, a need exists for such a compact jack with contacts that are spaced from an outer jack shield, wherein shorting to the jack shield or sparking to the jack shield during periods of high voltage is minimize or eliminated.

SUMMARY OF THE INVENTION

The present invention is a modular jack assembly which includes an outer insulative housing having top and bottom walls and opposed lateral walls while defining an interior section. This housing also has front and rear open ends. This assembly also includes an insulative insert having a top section, an upper side and a rear section having a base side and a recess. The jack is positioned so that the upper side of its top section is adjacent to top side of the insulative housing such that its terminal end extends into the interior section of the insulative housing and the rear section at least partially covers the rear open end of the insulative housing. This assembly also includes an electronic component mounted in the recess in the rear section of the insulative insert. A conductor is mounted on the insulative insert. This modular jack provides a filtering element which is adapted to be easily and compactactly mounted in the jack.

Such modular jack has an insulative insert having outer walls defining a first recess therein. The insert is mounted within an interior section of an insulating housing. A cap having outer walls defining a second recess therein is mounted within the first recess of the insulative insert so that the first recess and the second recess together form an internal cavity for receiving an electrical device such as the filtering clement therein. At least one conductive contact having first and second elongate portions connected by a bridging portion is coupled to the jack. The first and second elongate portions together securely grasp the outer wall of the insert, and the bridge portion resides at an edge of the outer wall of the insert.

The cap also has a rear wall having a rear face that faces in a rear direction, and the contact also has a rear portion adjacent the cap and facing in the rear direction. The rear face of the rear wall of the cap extends farther in the rear direction than the rear portion of the contact. A grounding shield is fitted over the jack and has a generally planar rear panel with a rear face that faces in the rear direction. The rear panel covers the rear face of the rear wall of the cap and also covers the rear portion of the contact.

BRIEF DESCRIPTION OF THE DRAWINGS

The filtered modular jack assembly of the present invention is further described with reference to the accompanying drawings in which.

DETAILED DESCRIPTION OF THE PREFERRED EMBODIMENTS

Figure 1:
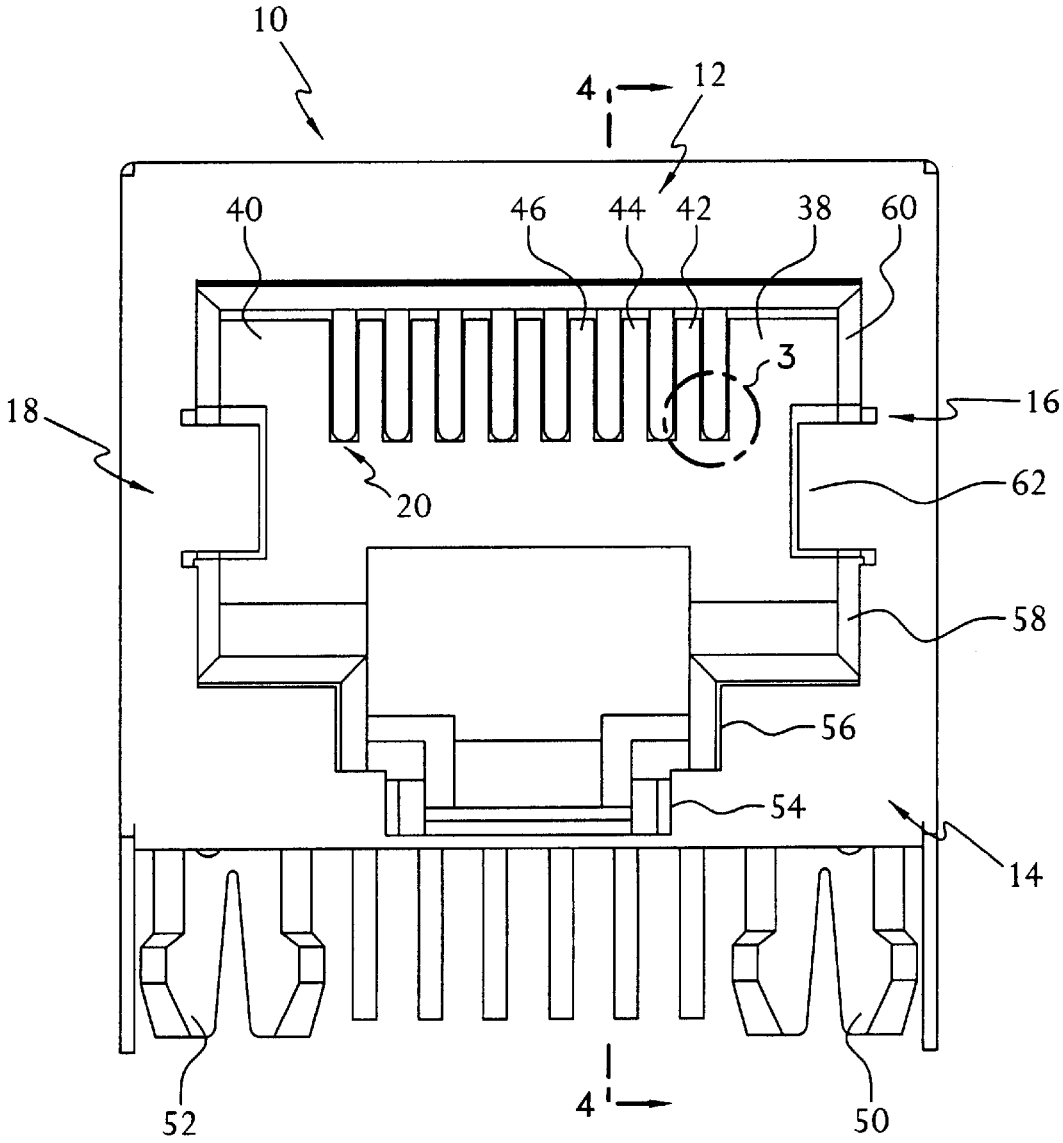
FIG. 1 is a front elevational view of a modular jack representing a first embodiment of the present invention.
Figure 3:
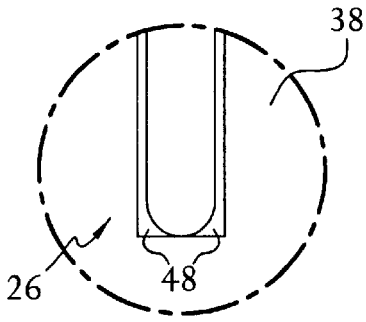
FIG. 3 is a detailed view of the area within circle 3 in FIG. 1.

Referring to FIGS. 1–10, the outer insulative housing is shown generally at numeral 10. This housing includes a top wall 12, a bottom wall 14 and a pair of opposed lateral walls 16 and 18. The housing is constructed of a thermoplastic polymer having suitable insulative properties and has conventional metallic exterior shielding. Within these walls is an interior section 20 which- has a rear open end 22 and a forward open end 24. Projecting upwardly from the bottom wall in this interior section there is a medial wall generally shown at numeral 26 which has a rear side 28 and a front side shown generally at numeral 30 which includes a bottom front side 31, a top front side 32 and a recessed medial front side 34 and an inclined top side 36 which slopes upwardly and forwardly from its rear side toward its front side. Adjacent to the lateral walls, the medial wall has lateral extensions 38 and 40 which serve as projections to retain other elements as will be hereafter explained. Interposed between these lateral extensions there are a plurality of wire separation extensions as at 42, 44 and 46 and between these wire separation extensions there are plurality of slots as at 48.

As will be appreciated by those skilled in the art and is further explained hereafter, the wall and recesses of the outer insulative housing interact to receive an insert so as to make electrical connection between the conductors in the housing and the insert.

Extending downwardly from the bottom wall there are pins 50 and 52. The lateral wall 16 includes a lower shoulder 54, another shoulder 56, a lower main wall 58, an upper main wall 60 and a recessed wall 62 interposed between the lower and upper main wall. It will be seen that the lateral wall 18 has substantially identical features as lateral wall 16. The top wall 12 includes an upper bridge section 64, a lower bridge section 66, a front recess 68 and a rear recess 70.

Figure 4:
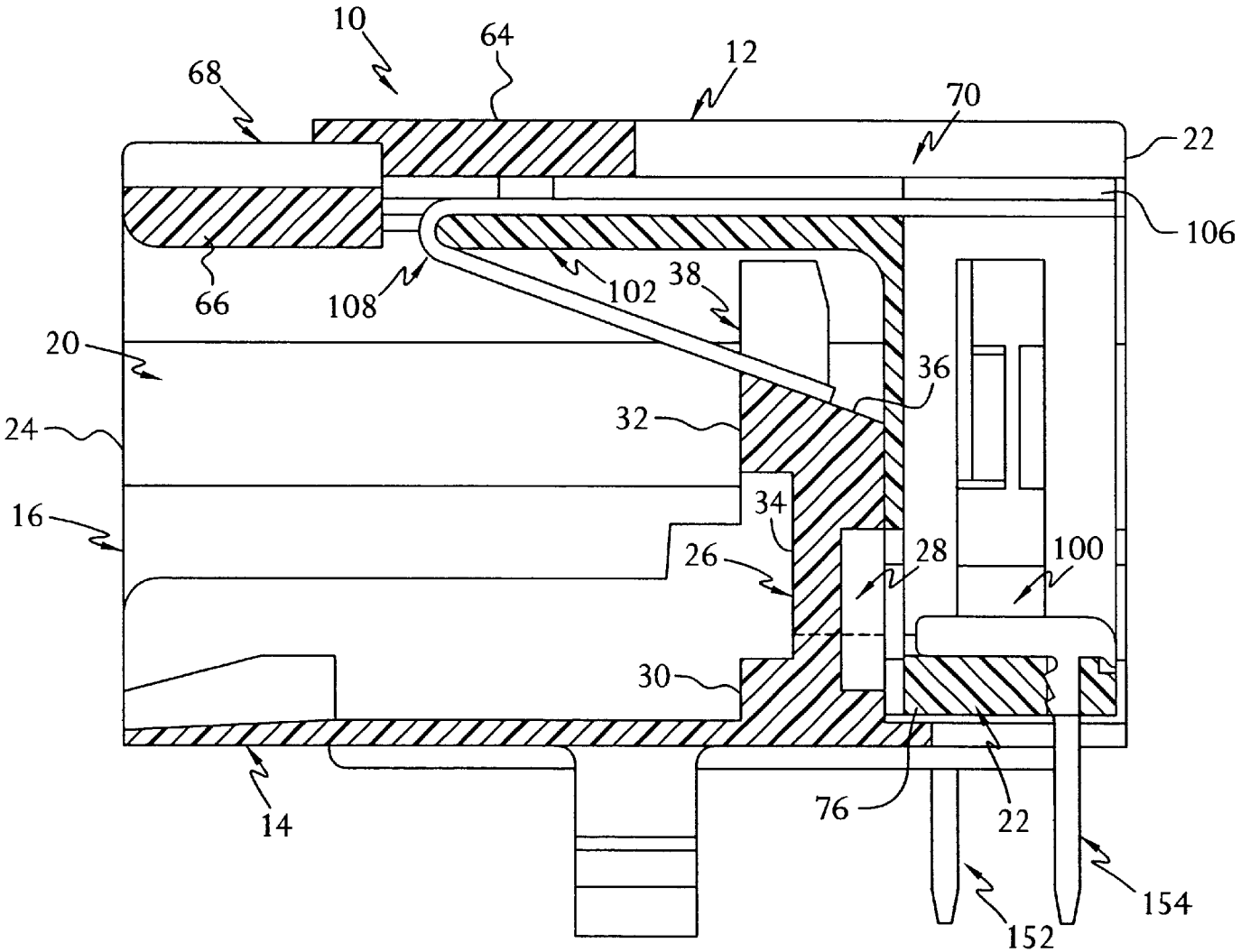
FIG. 4 is a cross sectional view through 4—4 in FIG. 1 in which for the purpose of showing other detail, shielding, the filter, and associated wires and the rear cap have been deleted.
Figure 5:
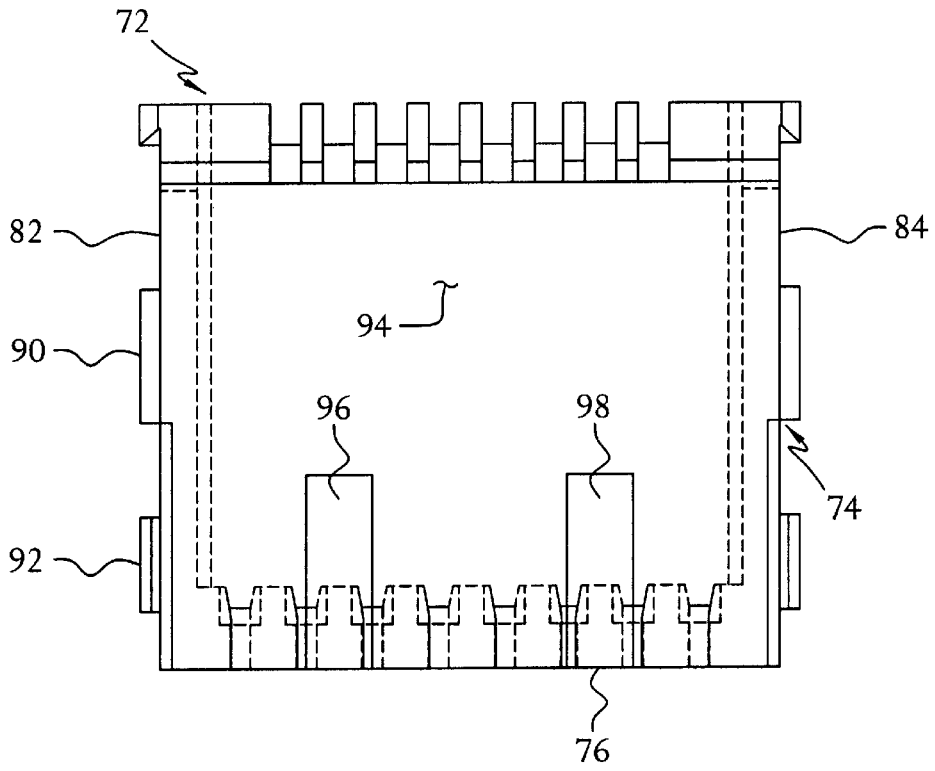
FIG. 5 is a front elevational view of the insulative insert used in the modular jack shown in FIG. 1.
Figure 7:
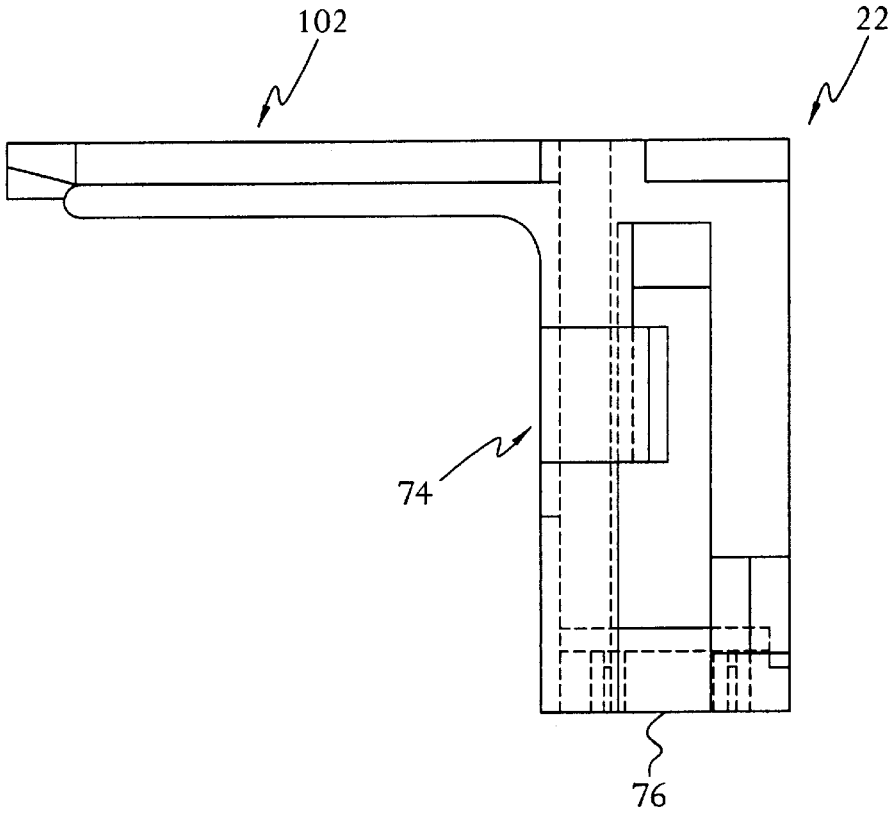
FIG. 7 is side elevational view of the insulative insert shown in FIG. 5.
Figure 8:
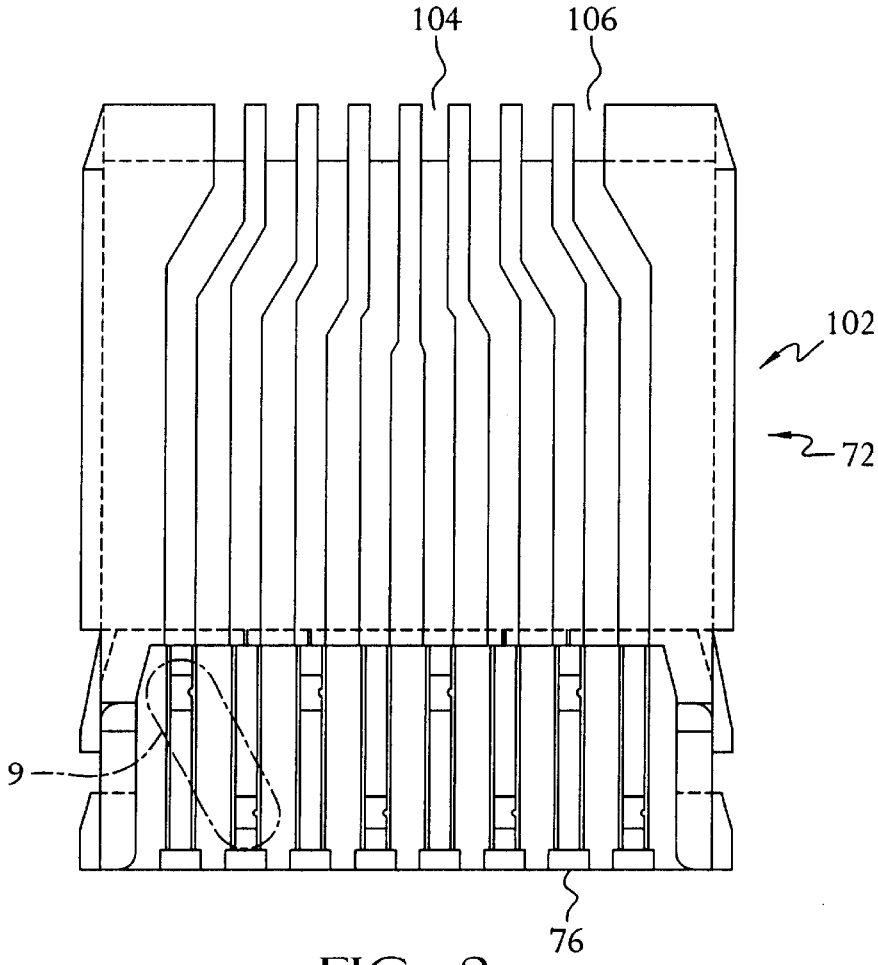
FIG. 8 is a top plan view of the insulative insert shown in FIG. 5.
Figure 6:
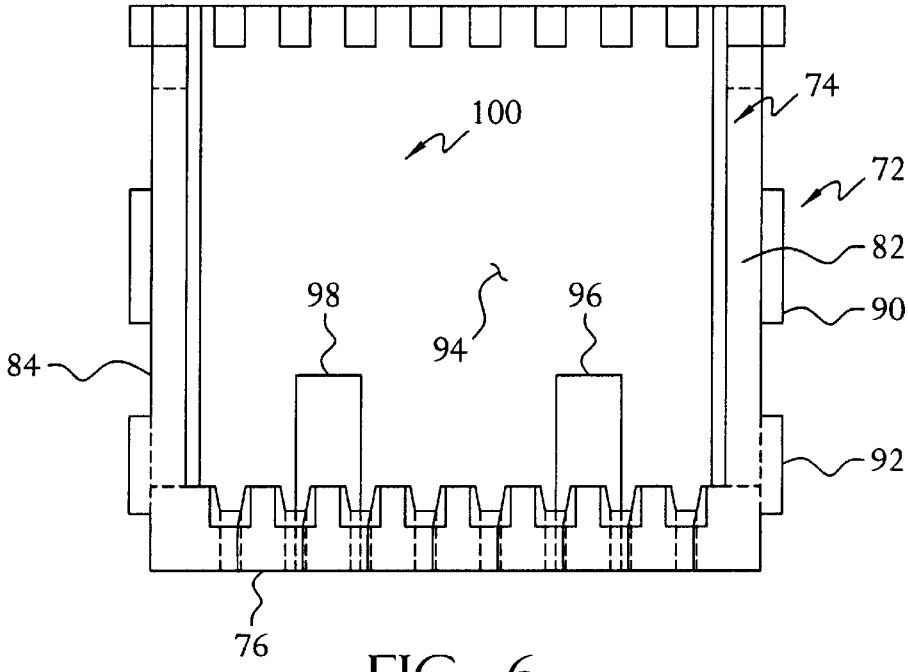
FIG. 6 is a rear elevational view of the insulative insert shown in FIG. 5.
Figure 9:
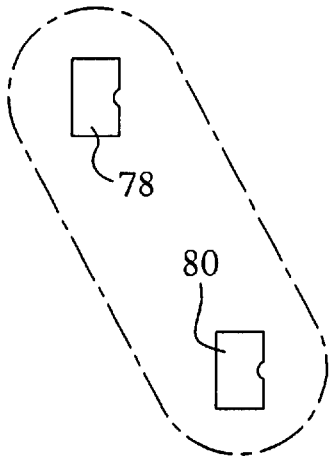
FIG. 9 is a detailed view of area 9 in FIG. 8.
Figure 10:
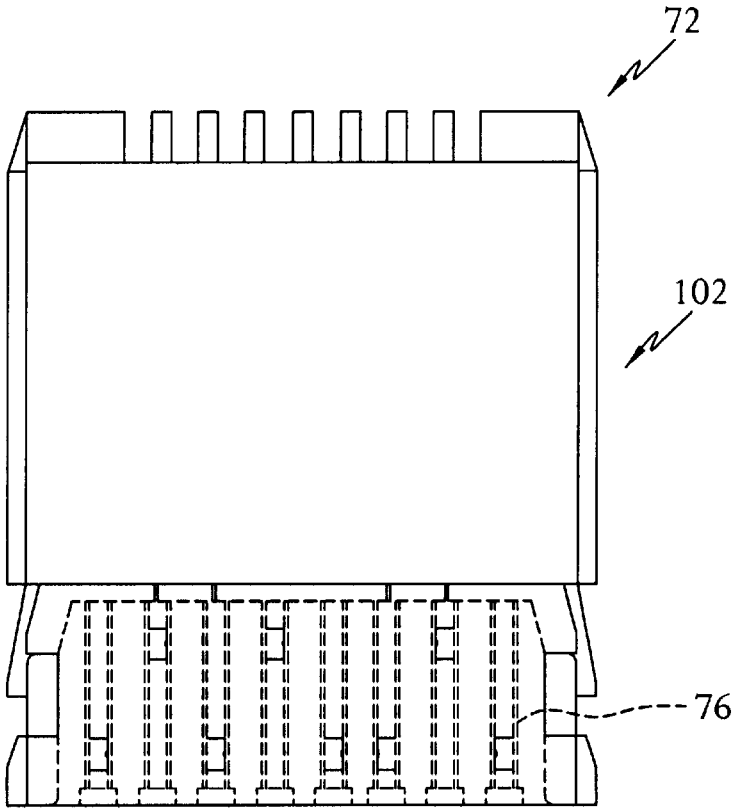
FIG. 10 is a bottom plan view of the insulative insert shown in FIG. 5.
Figure 12:
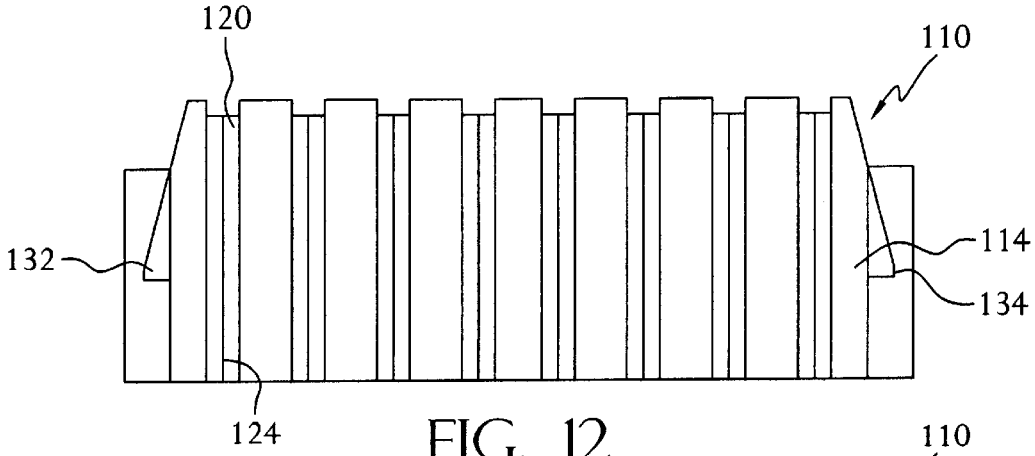
FIG. 12 is a top plan view of the cap shown in FIG. 11.
Figure 11:
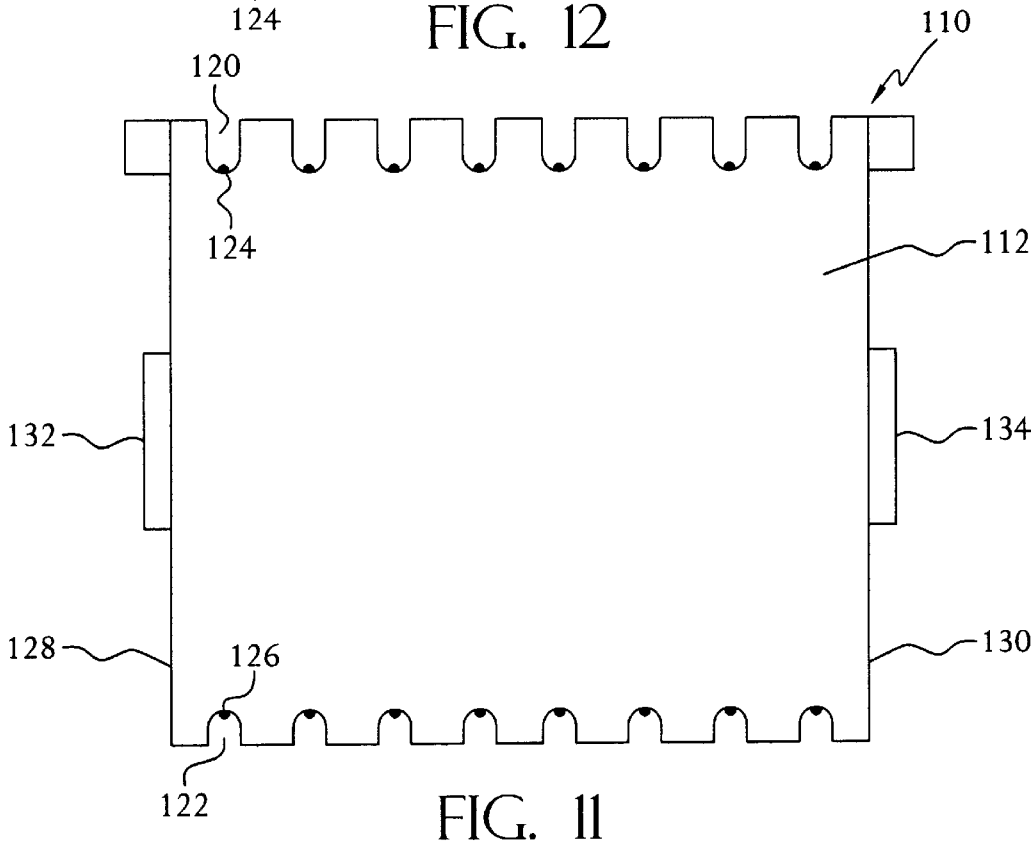
FIG. 11 is a rear end view of the cap clement used in the modular jack shown in FIG. 1.
Figure 13:
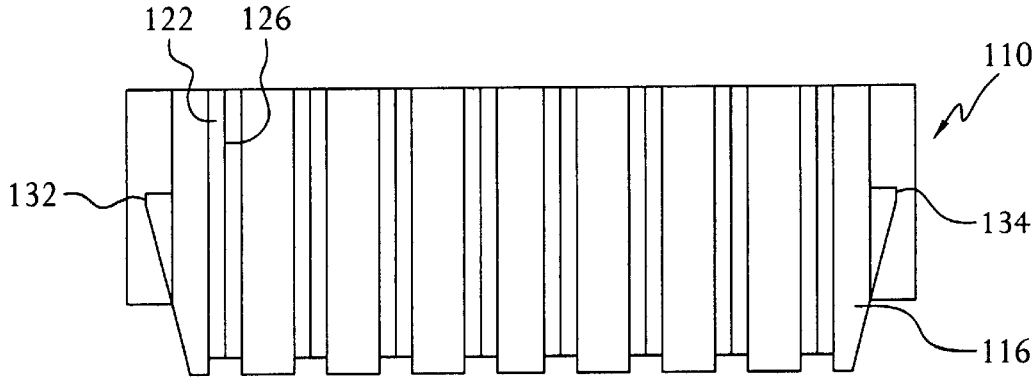
FIG. 13 is a bottom plan view of the cap shown in FIG. 11.
Figure 15:
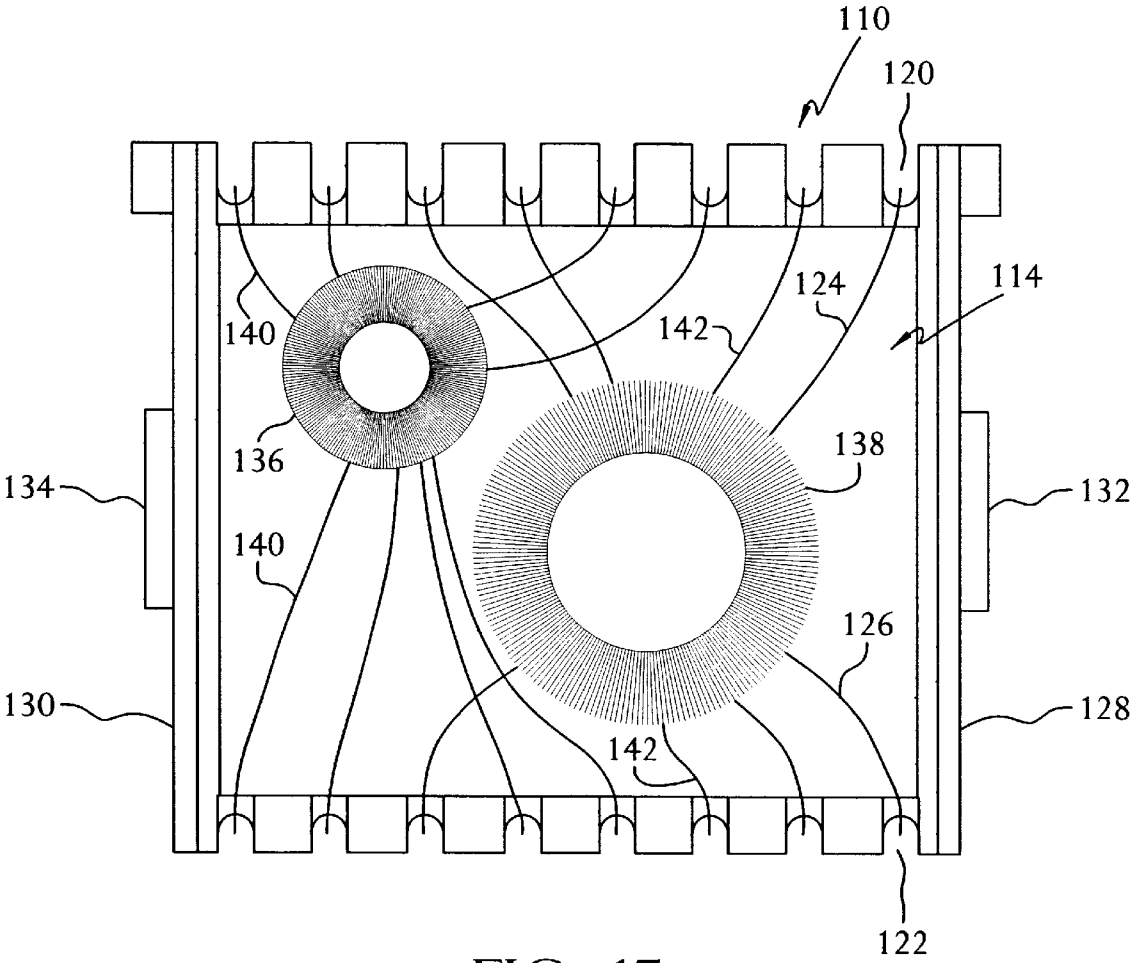
FIG. 15 is a interior view of the cap shown in FIG. 11.
Figure 14:
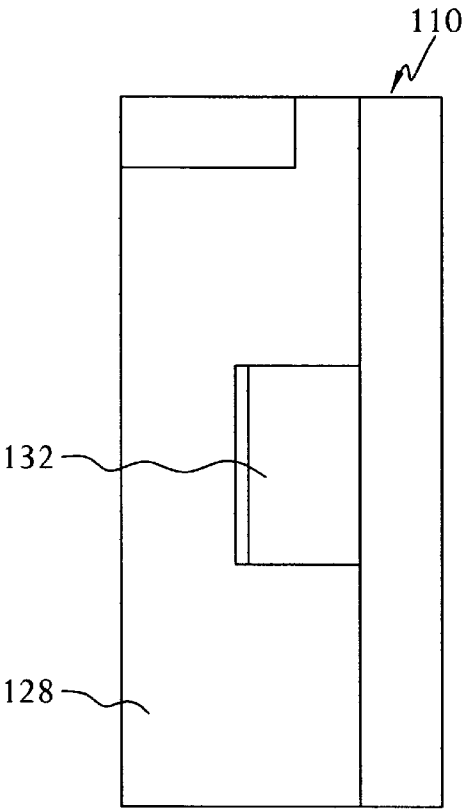
FIG. 14 is a side elevational view of the cap shown in FIG. 11.

Referring particularly to FIGS. 5–10, the insulative insert is shown generally at numeral 72. This insert has a vertical section shown generally at numeral 74 which includes a base wall 76. The base wall has a plurality of vertical bores as at 78 and 80. The vertical section also includes opposed side walls 82 and 84. Side wall 82 has a pair of latches 86 and 88. Side wall 84 has a pair of latches 90 and 92. The vertical section also has a front wall 94 in which there are apertures 96 and 98. Finally the vertical section 94 of the insert 72 has a recess 10,0. The insert also has a horizontal section shown generally at numeral 102 which has a plurality of grooves as at groove 104 and 106 which extend from the rear to the front of this horizontal section. In these grooves there are conductors as at wire 108 (FIG. 4).

Figure 2:
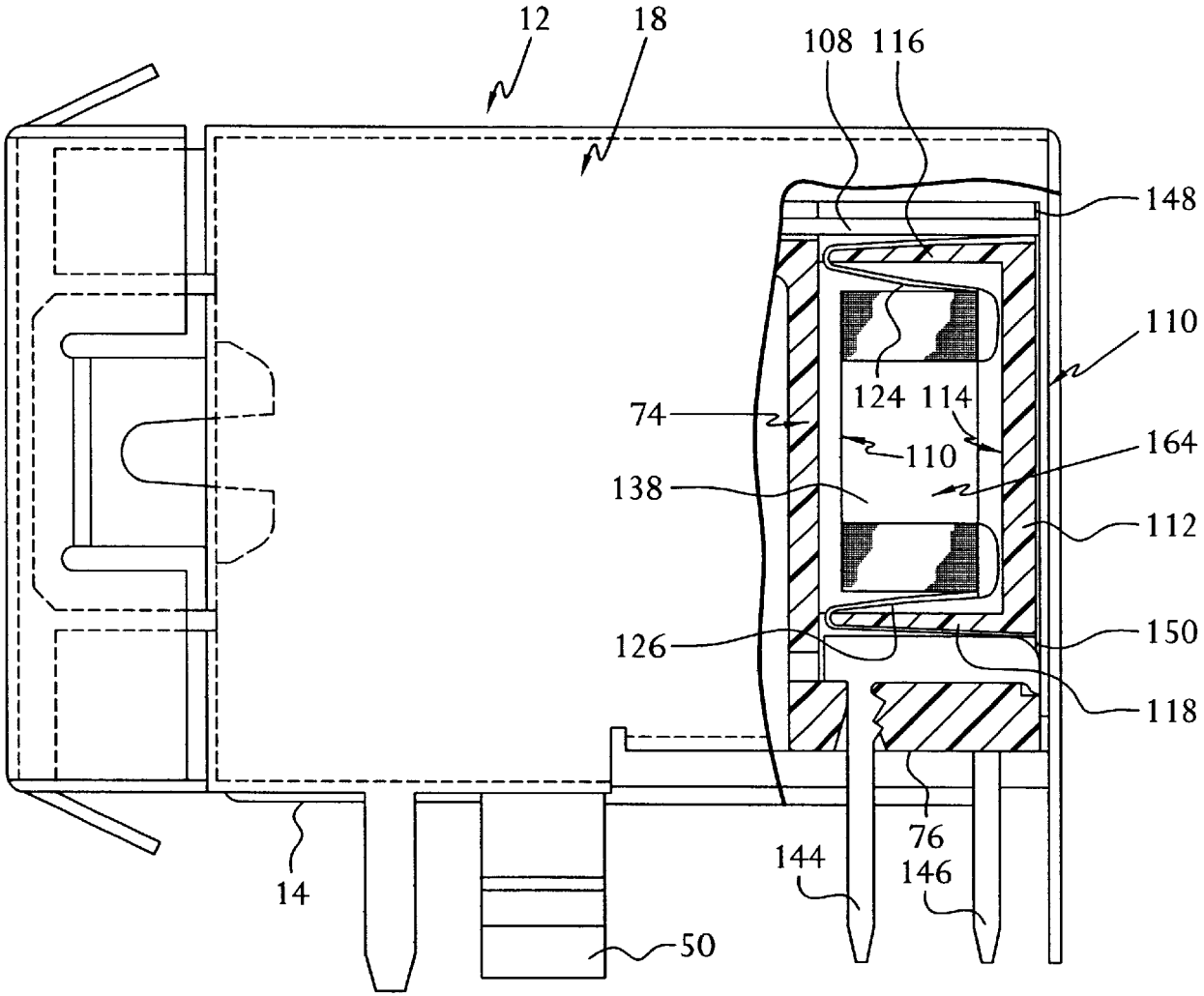
FIG. 2 is a cut away side elevational view of the modular jack shown in FIG. 1.

Referring particularly to FIG. 2 and 11–15, the cap element is shown generally at numeral 110. This cap element has a rear wall 112 and on the reverse side of this wall there is a recess 114. The cap also has a top end wall 116 and a bottom end wall 118 which have respectively grooves as at groove 120 and 122. Conductors as at wire 124 and 126 are positioned in each of these grooves. The cap also has side walls 128 and 130 which have respectively latches 132 and 134 for engaging the side walls 82 and 84 of the insulative insert. A filter means such as common mode chokes 136 and 138 are mounted on the inner or recess side of the wall 112. Other filtering elements known to those skilled in the art such as inductive serial filters, differential filters, low pass capacitive filters and other magnetic filters may be substituted for the common mode choke. Conductors as at wire 140 extend from the top wall to the common mode choke 136 and then to the bottom wall. Wires as at 142 extend from the top wall to the common mode choke 138 and then to the bottom wall. These wires are wound around the common mode chokes and serve to retain the common mode chokes in their positions. Referring particularly to FIG. 2, it will be appreciated that the wires that extend upwardly from the common mode chokes such as wire 124 are connected to the wires mounted in the insert such as wire 108. That is as wire 124 extends along the outside of wall it abuts wire 108. It will also be appreciated that the wires that extend downwardly from the common mode chokes such as wire 126 are connected to contacts such as contacts 144 and 146. That is, for example, as wire 126 extends' along the outside of wire 118 it abuts contact 144. Another wire (not shown) abuts contact 146 in a similar way. At the ends of wires 124 and 126 there is an ultrasonic weld 148 and 150, respectively. Referring particularly to FIG. 4, it will be seen that contacts 152 and 154 are positioned to extend from the base wall 76 of the insert vertical section 74. To better show the recess 100 of the insert 72, the common mode chokes as at 136 and their connecting wires and the cap 110 are not shown. It will be understood, however, that wires from the common mode chokes are connected to the contacts 152 and 154 and to the insert wires as at wire 108 in the same way as is shown in FIG. 2.

Figure 16A:
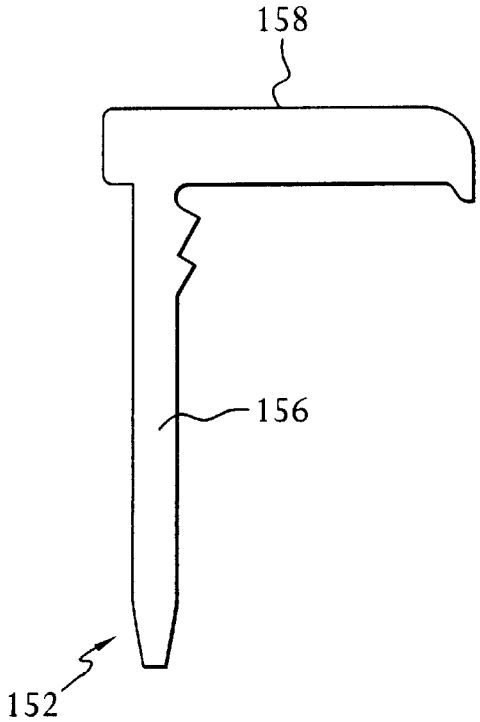
FIGS. 16*A* and 16*B* are side elevational views of two electrical contacts which are used in the modular jack shown in FIG. 1.
Figure 16B:
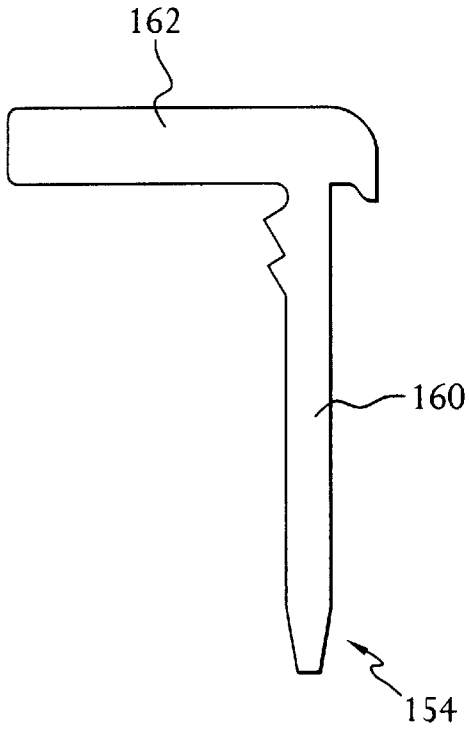

Referring particularly to FIG. 16*a*, it will be seen that contact 152 is comprised of a major vertical section 156 and a minor horizontal section 158. Referring particularly to FIG. 16*d*, it will be seen that contact 154 is comprised of a major vertical section 160 and a minor horizontal section 162 which is oriented in opposed relation to the horizontal section 158 of contact 152. Referring particularly to FIG. 2, it will be appreciated that the recess 100 and the cap element 110 together form an internal cavity 164 in the vertical section 74 of the insulative insert for containment of the common mode chokes.

It will be appreciated that a compact modular jack has been described which facilitates the use of several different types of filtering elements depending on specific needs. That is, a large variety of filters or other components may be housed in the recess of the insert. Consequently, the use of standard package as is required in many prior art modular jacks is not necessary so as to allow greater flexibility in meeting specific application needs.

Figure 17:
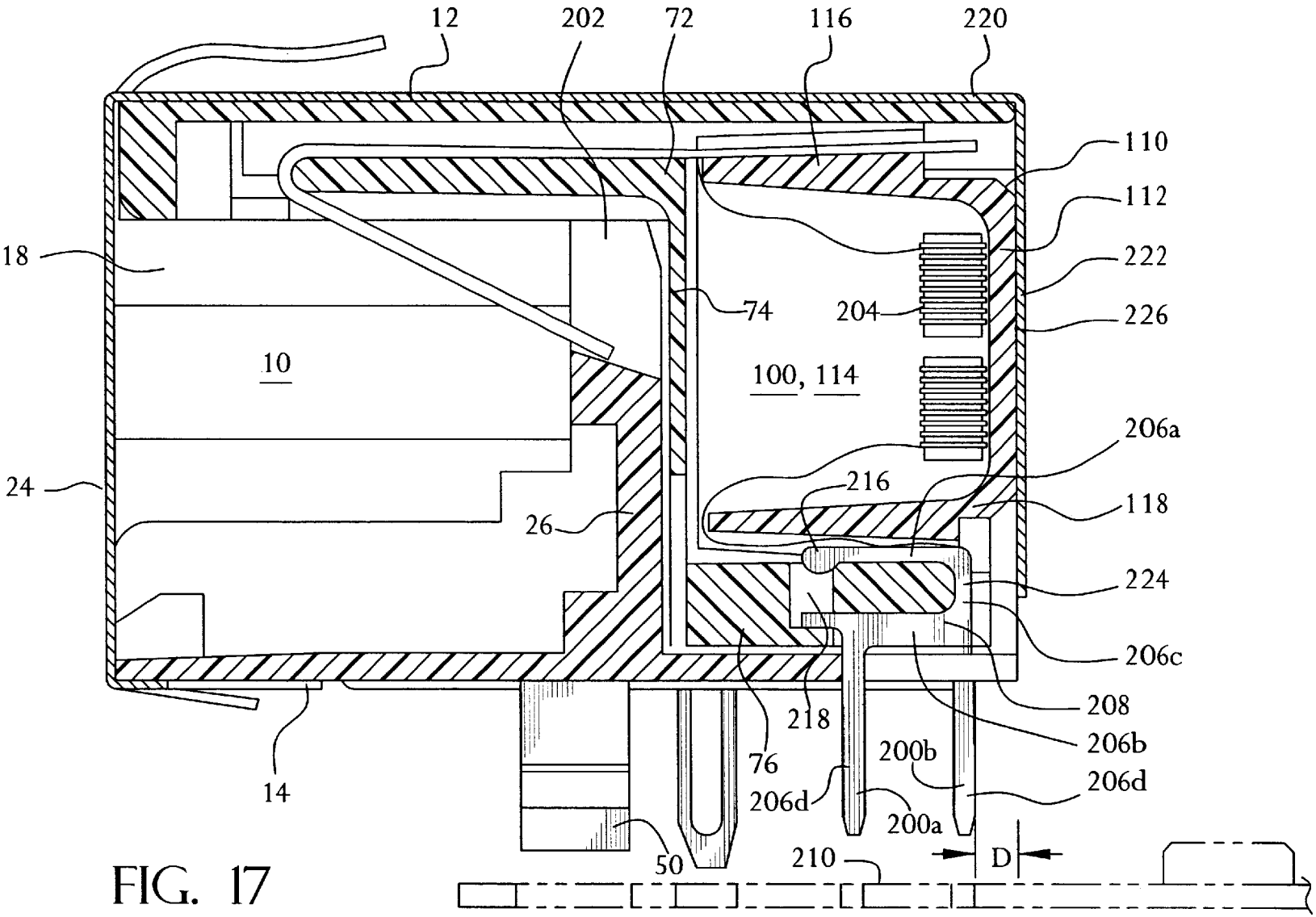
FIG. 17 is a cross-sectional side view similar to that of FIG. 4, and shows a modular jack in accordance with a second embodiment of the present invention.
Figure 17A:
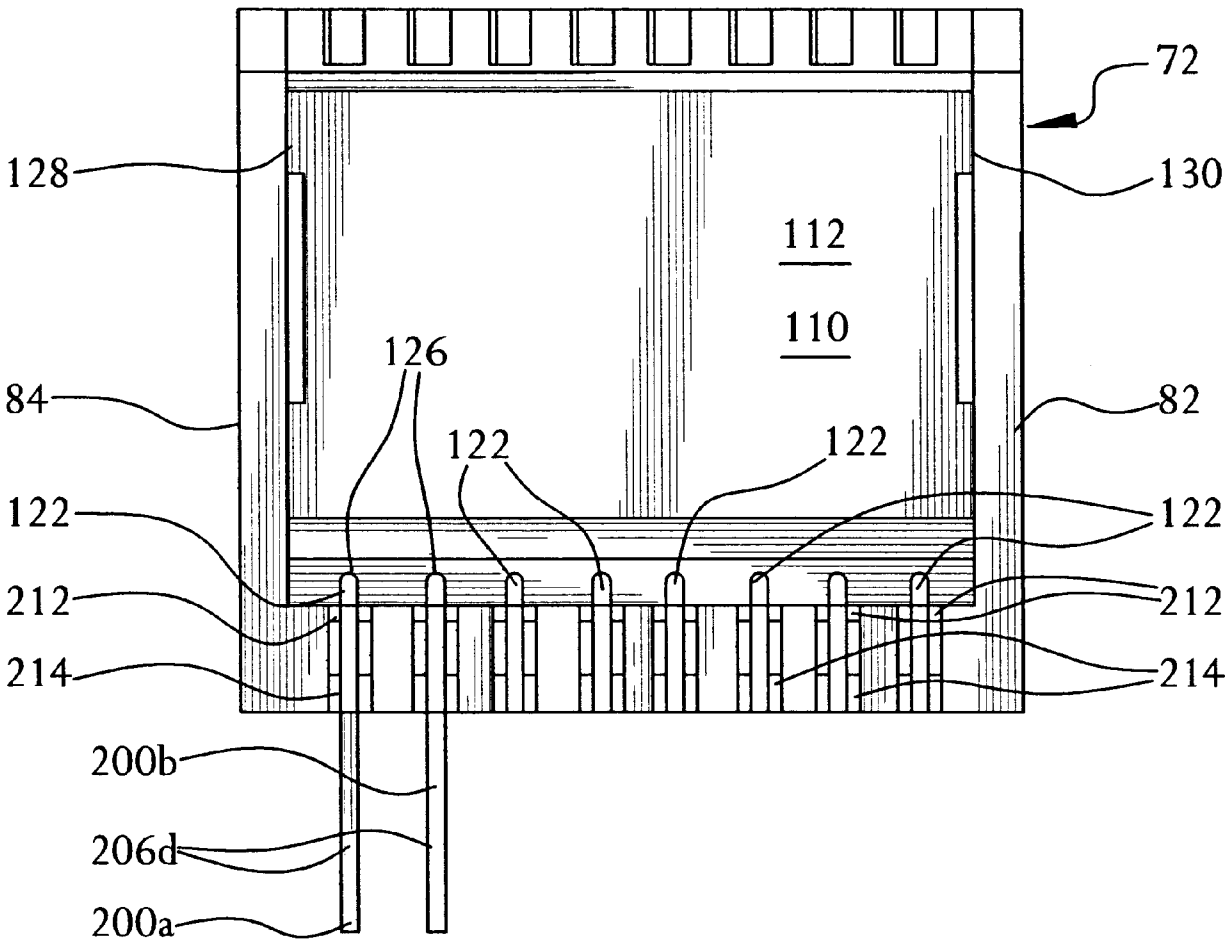
FIG. 17A is a rear elevational view of the modular jack shown in FIG. 17 without the conductive shield.

Referring now to FIGS. 17 and 17A, wherein like numerals are used to indicate like elements in FIGS. 1–16*b*, there is seen a second embodiment of the modular jack of the present invention that is similar to the first embodiment shown in FIGS. 1–16*b* in that:

the insert 72 has outer walls 82, 84, 76 that define a recess 100;

the insert 72 is mounted within an interior section 202 of an insulating housing 10;

the jack has a cap 110 with outer walls including a rear wall 112, top and bottom and walls 116, 118, and side walls 128, 130 where such outer walls define a second recess 114 in such cap 110; and the second embodiment, the cap 112 is mounted within the first recess 100 of the insert 72 so that the first and second recesses 100, 114 together form an internal cavity for receiving an electrical device 204 therein.

As should be understood, the electrical device 204 is a filter or the like, although it will be recognized that other electrical devices 204 may be received in the internal cavity 100/114 without departing from the spirit and scope of the present invention. For example, the electrical device may be a resistor or capacitor, a simple electronic circuit, an antenna, a complex integrated circuit, etc.

Importantly, in the second embodiment of the present invention, the jack can receive multiple kinds of contacts 200*a*, 200*b*, 200*c*, etc (FIGS. 18A–18C), where each kind of contact has common features that allow the contact to be received by the jack. Accordingly, in the second embodiment of the present invention, the jack can have any of a plurality of contact configurations, including configurations that include one kind of contact and configurations that have multiple kinds of contacts. Of course, any particular configuration may be employed without departing from the spirit and scope of the present invention.

Figure 18A:
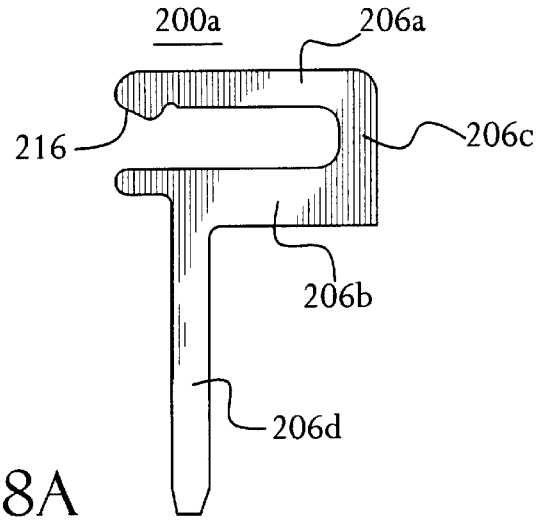
FIGS. 18A, 18B, and 18C arc side elevational views of three electrical contacts which may be used in the modular jack shown in FIGS. 17 and 17A.
Figure 18B:
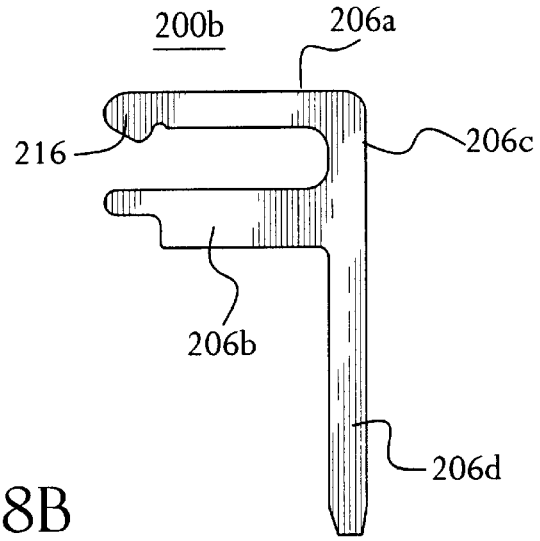
Figure 18C:
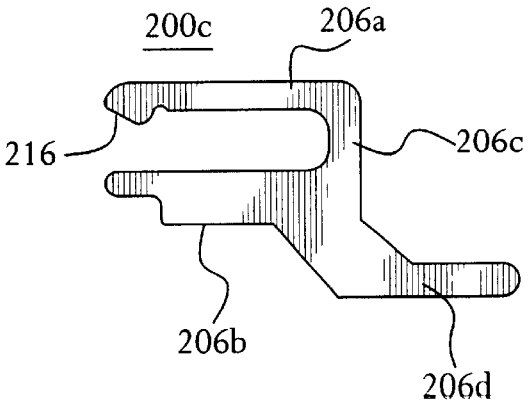

In particular, and referring now to FIGS. 18A–18C, each contact 200*a*, 200*b*, 200*c*, etc. is a conductive contact with first and second elongate portions 206*a*, 206*b* connected by a bridging portion 206*c*. As best seen in FIG. 17, regardless of which kind of contact is employed, the first and second elongate portions 206*a*, 206*b* of such contact together securely grasp the outer wall 76 of the insert 72, and the bridge portion 206*c* of such contact resides at an edge 208 of such outer wall 76 of such insert 72. Preferably, and as seen, the outer wall 76 of the insert 72 which is grasped by the first and second clongate portions 206*a*, 206*b* of the contact is a bottom facing wall that faces toward an underlying substrate 210 to which the jack is mounted to or to be mounted to. When the jack is mounted to the substrate 210, the contacts 200*a*, 200*b*, 200*c*, etc. of the jack make contact with contacting pads or the like (not shown) on the substrate 210, thereby making electrical contact with circuitry (not shown) mounted to the substrate 210 or coupled to the substrate 210.

As should be understood, the substrate 210 may be a circuit board, a backplane, or the like, or may be any other type of substrate without departing from the spirit and scope of the present invention. The substrate 210 preferably includes appropriate mounting devices for receiving the jack. For example, the substrate 210 may include apertures for receiving mounting projections or the like located on the jack. Any mounting structure may be employed in the substrate 210 and in the jack without departing from the spirit and scope of the present invention.

As seen in FIGS. 18A–18C, each contact 200*a*, 200*b*, 200*c*, etc. has a contacting portion 206*d* that extends from the second elongate portion 206*b* to contact the underlying substrate 210. As seen in FIGS. 18A and 18B, the contacting portion 206*d* may extend generally perpendicularly with respect to the second elongate portion 206*b*, from either a proximal sub-portion of the second elongate portion 206*b* (as seen in FIG. 18A) or from a distal sub-portion of the second elongate portion 206*b* (as seen in FIG. 18B). Referring still to FIGS. 18A and 18B, a plurality of such contacts 200*a* and/or 200*b* may be mounted to a jack, wherein the perpendicularly extending contact portion 206*d* of each such contact on such jack is inserted within a respective receiving aperture in an underlying substrate 210 during mounting of the jack to such substrate 210 (i.e., through-hole-mounting) and is then secured by way of a soldering operation or the like. As may be appreciated, each receiving aperture is associated with a contacting pad or the like (not shown) on the substrate 210. By alternating contacts 200*a*, 200*b* in a jack, two staggered rows of contacting portions 206*d* may be achieved on the underside of such jack. Alternatively, by using only one kind of contact 200*a* or 200*b*, a single row of contacting portions 206*d* may be achieved.

As seen in FIG. 18C, the contacting portion 206*d* may also extend generally parallel to the second elongate portion 206*d*, either from the distal sub-portion of such second elongate portion 206*b* (as seen in FIG. 18C) or from the proximal sub-portion thereof (not shown). As should be understood, although the contacting portion 206*d* may extend generally parallel to the second elongate portion 206*b*, such contacting portion 206*d* requires a perpendicular offset in order for such contacting portion 206 to be laterally offset from the second elongate portion 206*b*. Referring still to FIG. 18C, a plurality of such contacts 200*c* may be mounted to a jack, wherein the parallel-extending contacting portion 206*d* of each such contact on such jack is surface-mounted to a pad (not shown) on an underlying substrate 210 and is then secured by way of a soldering operation or the like. As may be appreciated, in connection with any jack, contacts 200*a*, 200*b*, 200*c*, etc. may be mixed and matched in any combination without departing from the spirit and scope of the present invention.

Referring now to FIG. 17A in particular, in the second embodiment of the present invention, the insert 72 has a first set of grooves 212 formed on an interior part of an outer wall 76 thereof, and also a second set of grooves 214 formed on an exterior part of the outer wall 76 thereof opposite the first set of grooves 212. As seen, and as was discussed above, the outer wall 76 is preferably a facing wall that faces toward the underlying substrate 210. As also seen in FIG. 17A, the cap 110 preferably has a third set of grooves 122 formed on an exterior part of an outer wall 118 thereof. As seen and should be understood, such outer wall 118 is preferably the bottom end wall 188 of such cap 110. As should be appreciated, the first set of grooves 212 preferably align with and respectively correspond to the second set of grooves 214, and the third set of grooves 122 aligns with and respectively corresponds to the first set of grooves 212 and by extension the second set of grooves 214.

Accordingly, a contact 200*a*, 200*b*, 200*c*, etc. may be mounted in a groove from the first set of grooves 212, a corresponding groove from the second set of grooves 214, and a corresponding groove from the third set of grooves 122. In particular, when any contact is mounted to the jack, the first elongate portion 206*a* of such contact fits in and contacts a conductor 126 within one groove in the third set of grooves 122 in the cap 110. Such first elongate portion 206*a* also fits in a corresponding groove in the first set of grooves 212 in the insert 72. Additionally, the second elongate portion 206*b* of such contact fits in a corresponding groove in the second set of grooves 214 in the insert 72.

In any contact 200*a*, 200*b*, 200*c*, etc., it is preferable that the first and second elongate portions 206*a*, 206*b* of such contact together extend generally in parallel, as is seen in FIGS. 18A–18C. The first elongate portion 206*a* of such contact may include a projection 216 that snap-fits within a recess 218 (FIG. 17) within any groove in the first set of grooves 212. Alternatively, the recess 218 may be in the second or third sets of grooves 214, 122 and the projection 218 may be appropriately located and oriented without departing from the spirit and scope of the present invention. As should be understood, such projection and recess 216, 218 ensure that the contact when graspingly mounted onto the outer wall 76 of the insert 72 is securely retained on such outer wall 76.

Preferably, the bridging portion 206c of each contact 200*a*, 200*b*, 200*c*, etc. spaces the first and second elongate portions 206*a*, 206*b* of such contact apart a distance approximately equal to the thickness of the outer wall 76 of the insert 72. Also preferably, the first elongate portion 206*a* is biased slightly toward to the second elongate portion 206*b* such that the contact grasps the outer wall 76 in the manner discussed above.

Preferably, the first and third sets of grooves 212, 122 are dimensioned and the insert 72 and cap 110 are also dimensioned to received the first elongate portion 206*a* of each contact 200*a*, 200*b*, 200*c*, etc. and also the conductor 126 there between. With all the contacts appropriately mounted to the insert 72 and the cap 110 mounted to the insert 72 to form the jack, such jack may then be solder dipped in a solder bath or the like to secure the first elongate portion 206*a* of each contact to the corresponding conductor 126 in the region of the third set of grooves 122 within the cap 110.

In performing such solder dip, the rear side of the jack ( i.e., the side to the right in FIG. 17) is normally inserted into solder and the dipped jack is then removed from such solder. It will be recognized that as a result of such removal, a solder spike (not shown) may extend in a rearward direction from each contact 200*a*, 200*b*, 200*c*, etc., and specifically from the juncture of such contact with the respective conductor 126. Moreover, it will be appreciated that the jack is oftentimes encased within a conductive shield 220, and that such spike may thus either contact the shield 220 or be close enough to such shield 220 to allow spark-over at higher voltages. In order to prevent such sparkover, and in order to otherwise isolate each contact 200*a*, 200*b*, 200*c*, etc. from the shield 220, it is preferable that such shield 220 is spaced from the rear portion of each contact a distance D of about 1 mm, as is shown in FIG. 17.

In particular, it is seen in FIGS. 17 and 17A (the shield 220 not being shown in FIG. 17A for the sake of clarity) that the rear wall 112 of the cap 110 has a rear face 222 that faces in a rear direction (i.e., toward the right in FIG. 17), and that each contact 200*a*, 200*b*, 200*c*, etc. has a rear portion 224 adjacent the cap 110, where the rear portion 224 also faces in the rear direction. Importantly, the aforementioned ground shield 220 is fitted over the jack and has a generally planar rear panel 226 generally perpendicular to the rear direction. Such rear panel 226 covers the rear face 222 of the rear wall 112 of the cap 110 and also covers the rear portion 224 of each contact. Typically, the rear panel 226 does not extend down past the rear portion 224 of each contact in order that such panel 226 does not interfere with the contacting portion 206*d* of each contact contacting the underlying substrate 210.

As should be understood, the shield 220 is grounded or is to be grounded, and therefore the rear panel 226 of the shield 220 is not to touch each contact 200*a*, 200*b*, 200*c*, etc., even if such rear panel 226 touches the rear face 222 of the rear wall 112 of the cap 110, as is seen in FIG. 17. As was discussed previously, the rear panel 226 of the shield 220 is preferably spaced from the rear portion 224 of the contact by a distance D of about 1 mm, although greater spacing may be employed without departing from the spirit and scope of the present invention. Preferably, the aforementioned spacing is created by having the rear face 222 of the rear wall 112 of the cap 110 extend farther in the rear direction (i.e., toward the right in FIG. 17) than the rear portion 224 of each contact. In such a situation, the rear panel 226 of the grounding shield 220 can in fact come into close contact with the rear face 222 of the cap 110 (as shown in FIG. 17) while still achieving the 1 mm separation from the rear portion 224 of each contact.

In a comparison of the second embodiment of the present invention as shown in FIGS. 17 and 17A and the first embodiment of the present invention as shown in FIG. 4, for example, it is seen that both jacks occupy about the same space, have the same "footprint", and are in fact essentially interchangeable. As can be seen by such comparison, the design of the insert 72 and cap 110 in the second embodiment has been slightly modified as compared with the first embodiment to create more space within the internal cavity 100, 114, and each contact 200*a*, 200*b*, 200*c*, etc. is designed without any unnecessary rearward features. Of course, other particular designs for the jack may be employed while still maintaining the spacing between each contact and the shield 220 without departing from the spirit and scope of the present invention.

While the present invention has been described in connection with the embodiments of the various figures, it is to be understood that other similar embodiments may be used or modifications and additions, may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack comprising:

an insulative insert having outer walls defining a first recess therein, the insert being mounted within an interior section of an insulating housing;

a cap having outer walls defining a second recess therein, the cap being mounted within the first recess of the insulative insert so that the first recess and the second recess together form an internal cavity for receiving an electrical device therein; and at least one conductive contact having first and second elongate portions connected by a bridging portion, the first and second elongate portions together securely grasping the outer wall of the insert, the bridge portion residing at an edge of the outer wall of the insert, the insert having a first set of grooves formed on an interior part of an outer wall thereof and a second set of grooves formed on an exterior part of the outer wall thereof opposite the first set of grooves, the first set of grooves aligning with and respectively corresponding to the second set of grooves;

the cap having a third set of grooves formed on an exterior part of an outer wall thereof, the third set of grooves aligning with and respectively corresponding to the first set of grooves;

the first elongate portion of the contact fitting in and contacting a conductor within one of the third set of grooves in the cap and fitting in a corresponding one of the first set of grooves in the insert; and the second elongate portion of the contact fitting in a corresponding one of the second set of grooves in the insert, the first and second elongate portions together extending generally in parallel.

2. The jack of claim 1 wherein the outer wall of the insert grasped by the first and second elongate portions of the contact is a facing wall for facing toward an underlying substrate.

3. The jack of claim 1 wherein the electrical device is a filter.

4. The jack of claim 1 wherein the contact further has a contacting portion extending from the second elongate portion for contacting an underlying substrate.

5. The jack of claim 4 wherein the contacting portion extends from a proximal sub-portion of the second elongate portion.

6. The jack of claim 4 wherein the contacting portion extends from a distal sub-portion of the second elongate portion.

7. The jack of claim 4 wherein the contacting portion extends generally parallel to the second elongate portion.

8. The jack of claim 4 wherein the contacting portion extends generally perpendicular to the second elongate portion.

9. A conductive contact for a modular jack, the modular jack comprising:

an insulative insert having outer walls defining a first recess therein, the insert being mounted within an interior section of an insulating housing; and a cap having outer walls defining a second recess therein, the cap being mounted within the first recess of the insulative insert so that the first recess and the second recess together form an internal cavity for receiving an electrical device therein;

the contact comprising first and second elongate portions connected by a bridging portion, the first and second elongate portions together for securely grasping the outer wall of the insert, the bridge portion for residing at an edge of the outer wall of the insert, the insert having a first set of grooves formed on an interior part of an outer wall thereof and a second set of grooves formed on an exterior part of the outer wall thereof opposite the first set of grooves, the first set of grooves aligning with and respectively corresponding to the second set of grooves;

the cap having a third set of grooves formed on an exterior part of an outer wall thereof, the third set of grooves aligning with and respectively corresponding to the first set of grooves;

the first elongate portion of the contact is for fitting in and contacting a conductor within one of the third set of grooves in the cap and for fitting in a corresponding one of the first set of grooves in the insert; and the second elongate portion of the contact is for fitting in a corresponding one of the second set of grooves in the insert, the first and second elongate portions together extending generally in parallel.

10. The contact of claim 9 further comprising a contacting portion extending from the second clongate portion for contacting an underlying substrate.

11. The contact of claim 10 wherein the contacting portion extends from a proximal sub-portion of the second elongate portion.

12. The contact of claim 10 wherein the contacting portion extends from a distal sub-portion of the second elongate portion.

13. The contact of claim 10 wherein the contacting portion extends generally parallel to the second elongate portion.

14. The contact of claim 10 wherein the contacting portion extends generally perpendicular to the second elongate portion.

15. A modular jack comprising:

an insulating housing having outer walls defining an interior section;

an insulative insert having outer walls defining a first recess therein, the insulative insert being mounted within the interior section of the insulating housing;

a cap having outer walls and a rear wall defining a second recess therein, the cap being mounted within the first recess of the insulative insert so that the first recess and the second recess together form an internal cavity for receiving an electrical device therein, the rear wall having a rear face facing in a rear direction;

at least one conductive contact having a rear portion adjacent the cap and facing in the rear direction, the rear face of the rear wall of the cap extending farther in the rear direction than the rear portion of the contact; and a grounding shield fitted over the jack and having a generally planar rear panel with a rear face facing in the rear direction, the rear panel covering the rear face of the rear wall of the cap and also covering the rear portion of the contact, the contact having first and second elongate portions connected by a bridging portion, the first and second elongate portions together securely grasping the outer wall of the insert, the bridge portion residing at an edge of the outer wall of the insert and being the rear portion of the contact, the insert having a first set of grooves formed on an interior part of an outer wall thereof and a second set of grooves formed on an exterior part of the outer wall thereof opposite the first set of grooves, the first set of grooves aligning with and respectively corresponding to the second set of grooves;

the cap having a third set of grooves formed on an exterior part of an outer wall thereof, the third set of grooves aligning with and respectively corresponding to the first set of grooves;

the first elongate portion of the contact fitting in and contacting a conductor within one of the third set of grooves in the cap and fitting in a corresponding one of the first set of grooves in the insert; and the second elongate portion of the contact fitting in a corresponding one of the second set of grooves in the insert, the first and second elongate portions together extending generally in parallel.

16. The jack of claim 15 wherein the rear panel of the shield touches the rear face of the rear wall of the cap.

17. The jack of claim 15 wherein the rear panel of the shield does not touch the contact.

18. The jack of claim 15 wherein the rear panel of the shield is spaced from the rear portion of the contact by about 1 mm.

19. The jack of claim 15 wherein the contact further has a contacting portion extending from the second elongate portion for contacting an underlying substrate.

20. The jack of claim 17 wherein the electrical device is a filter.

* * * * *